US012677996B2

(12) United States Patent
Cotsonas

(10) Patent No.: US 12,677,996 B2
(45) Date of Patent: Jul. 14, 2026

(54) TOWEL

(71) Applicant: Brian James Cotsonas, Jamestown, RI (US)

(72) Inventor: Brian James Cotsonas, Jamestown, RI (US)

( * ) Notice: Subject to any disclaimer, the term of this patent is extended or adjusted under 35 U.S.C. 154(b) by 204 days.

(21) Appl. No.: 18/401,658

(22) Filed: Jan. 1, 2024

(65) Prior Publication Data

US 2024/0245269 A1 Jul. 25, 2024

Related U.S. Application Data

(60) Provisional application No. 63/436,663, filed on Jan. 2, 2023.

(51) Int. Cl.
*A47K 10/02* (2006.01)

(52) U.S. Cl.
CPC ..... *A47K 10/02* (2013.01)

(58) Field of Classification Search
CPC ..... A47G 9/02; A47G 9/0207; A47G 9/04; A47K 10/00; A47K 10/02
See application file for complete search history.

(56) References Cited

U.S. PATENT DOCUMENTS 1,061,259 A * 5/1913 Blofield et al. ..... A47G 9/02 5/494
1,841,410 A * 1/1932 Karr ..... A47C 31/105 5/691
5,479,664 A * 1/1996 Hollander ..... A47G 9/0246 5/497
5,513,403 A * 5/1996 Wooten, Jr. ..... A47G 9/0246 5/497
6,185,766 B1 * 2/2001 Farrugia ..... A47G 9/0238 24/72.5
D670,125 S * 11/2012 Agarwall ..... D6/602
8,856,984 B1 * 10/2014 Donham ..... A47G 9/0246 5/497
9,924,813 B1 * 3/2018 Basten ..... A47G 9/02
9,999,308 B1 * 6/2018 Bernick ..... A47G 9/0238
D879,507 S * 3/2020 Burriss ..... D6/596
11,064,811 B2 * 7/2021 Guy ..... A47C 21/022
2008/0235870 A1 * 10/2008 Heide ..... A47G 9/068 5/482
2009/0205134 A1 * 8/2009 Wootten, Jr. ..... A47C 31/11 5/488
2013/0125307 A1 * 5/2013 Margalit ..... A47K 10/02 5/417
2015/0272400 A1 * 10/2015 Lan ..... A47K 10/02 15/209.1
2016/0332023 A1 * 11/2016 Taylor ..... B32B 5/18
2017/0208958 A1 * 7/2017 Alletto, Jr. ..... A47C 27/003
2017/0354276 A1 * 12/2017 Alletto, Jr. ..... A47G 9/0246
2018/0078048 A1 * 3/2018 Pearce ..... A47G 9/00
(Continued)

*Primary Examiner* — George Sun
(74) *Attorney, Agent, or Firm* — David R. Yohannan; Yohannan Law

(57) ABSTRACT

A towel having a plurality of attachment points provided along reinforced edges and/or corners of a towel base. Each attachment point may include a first cord having a longitudinal axis extending between first and second ends stitched or otherwise connected to the towel base. Second cords may also be stitched to the towel base edge, either on top of or next to each of the first cords. The first and second cords may have different stretch characteristics.

20 Claims, 4 Drawing Sheets

(56) References Cited

U.S. PATENT DOCUMENTS

| | | | | |
|---|---|---|---|---|
| 2018/0110348 | A1* | 4/2018 | Pearce | A47G 9/0253 |
| 2019/0090665 | A1* | 3/2019 | Tak | A47G 9/04 |
| 2019/0090666 | A1* | 3/2019 | Bishop | A47G 9/0261 |
| 2020/0046150 | A1* | 2/2020 | Mansoor | A47G 9/0246 |
| 2020/0271413 | A1* | 8/2020 | Dilling | F41C 33/002 |
| 2021/0177167 | A1* | 6/2021 | Jain | A47G 9/04 |

* cited by examiner

TOWEL

CROSS REFERENCE TO RELATED APPLICATIONS

This application claims the benefit of U.S. Provisional Application No. 63/436,663 filed Jan. 2, 2023, the disclosure of which is hereby incorporated by reference herein in its entirety.

FIELD OF THE INVENTION

One or more embodiments of the present invention relate to towels and blankets having integrated attachment structures.

BACKGROUND OF THE INVENTION

Currently available towels and blankets (collectively referred to herein as "towels" for ease of discussion) have no or limited ability to be attached to other structures, or to have their edges and corners drawn together to form a closed structure. Existing towels may include attachment features including either apertures, ties, or loops of material provided at or near the towel periphery. These attachment features permit the towel to be connected to other structures or to itself at attachment points. However, the available towel attachment features lack adequate robustness and flexibility in terms of attachment capability. Apertures need to be heavily reinforced, can be esthetically undesirable, and provide a port for dirt or sand to pass through the towel. Ties are difficult to use because they require tying, are prone to loosening or untying, and become knotted, particularly when wet. Ties are also unsightly and hang away from the towel when not fastened together. Loops are an improvement over apertures and ties, however, existing loop systems on towels employ loops that extend away from the towel edges or surface rendering them prone to catch on other items and appear unpleasing esthetically. Existing towel loops also are provided in only one orientation with respect to the towel and therefore have inferior ability to draw the towel material in alternative X-Y dimensions, when so desired.

In view of the foregoing, there is a need for a towel having attachment features that avoid the shortcomings of the prior art. Namely, there is a need for a towel incorporating an array of aligned paired attachment cords, formed by connecting the paired cords to the towel edges, that, when not in use, lie neatly flat against the surface of the towel when it is fully spread out on a planar surface.

Aligned paired attachment cords may also improve the strength and durability of the attachment points. Further, there is a need for a towel with attachment cords that are either stretchable, or which include both stretchable and non-stretchable elements to provide connection points having multiple characteristics. There is also a need for a towel with multiple cords of material at each attachment point having different lengths, cross-sectional shapes, cross-sectional sizes, and/or different cord stretch characteristics. There is also a need for a towel with multiple cords arranged vertically relative to each other and the towel base that are connected to reinforced edges of the towel.

OBJECTS OF THE INVENTION

Accordingly, it is an object of some, but not necessarily all embodiments of the present invention to provide a towel having attachment points, wherein multiple cords are provided at each attachment point.

It is also an object of some but not necessarily all embodiments of the present invention to provide a towel having multiple cords provided at each attachment point that lie neatly flat against the towel surface.

It is also an object of some but not necessarily all embodiments of the present invention to provide a towel having attachment points, wherein a cord of stretchable material and a cord of relatively non-stretchable material are provided at each attachment point.

It is another object of some, but not necessarily all embodiments of the present invention to provide a towel having attachment points, wherein two cords arranged vertically adjacent or laterally adjacent relative to each other and an underlying towel base are provided at each attachment point.

It is another object of some, but not necessarily all embodiments of the present invention to provide a towel having attachment points, wherein two cords having different stretch characteristics are provided at each attachment point.

It is another object of some, but not necessarily all embodiments of the present invention to provide a towel having attachment points, wherein multiple cords having different lengths or sizes or cross-sectional shapes or diameters are provided at each attachment point.

It is another object of some, but not necessarily all embodiments of the present invention to provide a towel having flat stretchable cords and generally non-stretchable cords connected with end stitching to reinforced towel edges.

SUMMARY OF EMBODIMENTS OF THE INVENTION

Responsive to the foregoing challenges, Applicant has developed an innovative towel comprising: a towel base; a plurality of attachment points provided along the edges of the towel base; wherein each attachment point includes a first cord having a longitudinal axis extending between first and second ends stitched or otherwise connected to the towel base at a reinforced towel corner, and a second cord overlaying the first cord, said second cord having a longitudinal axis extending between first and second ends stitched or otherwise connected to the towel base, and wherein said first and second cord longitudinal axis are oriented at approximately a forty-five degree angle relative to intersecting first and second towel edges at the reinforced towel corner.

Applicant has further developed an innovative towel comprising: a base sheet of flexible textile material having a first, a second, a third and a fourth generally linear reinforced edge each formed by attaching a folded over portion of the base sheet of flexible textile material to an adjacent portion of the base sheet of flexible textile material or by attaching a strip of textile material to the base sheet of flexible textile material, wherein the first and second reinforced edges meet at a first corner, the second and third reinforced edges meet at a second corner, the third and fourth reinforced edges meet at a third corner, and the first and fourth reinforced edges meet at a fourth corner; a first cord having a longitudinal axis extending between first and second ends, said first cord first end connected to the first reinforced edge near the first corner, and said first cord second end connected to the second reinforced edge near the first corner; a second cord adjacent to the first cord, said second cord having a longitudinal axis extending between first and second ends, said second cord first end connected to the first reinforced edge near the first corner, and said second cord second end connected to the second reinforced edge near the first corner; a third cord having a longitudinal axis extending between first and second ends, said third cord first end connected to the second reinforced edge near the second corner, and said third cord second end connected to the third reinforced edge near the second corner; a fourth cord adjacent to the third cord, said fourth cord having a longitudinal axis extending between first and second ends, said fourth cord first end connected to the second reinforced edge near the second corner, and said fourth cord second end connected to the third reinforced edge near the second corner; a fifth cord having a longitudinal axis extending between first and second ends, said fifth cord first end connected to the third reinforced edge near the third corner, and said fifth cord second end connected to the fourth reinforced edge near the third corner; a sixth cord adjacent to the fifth cord, said sixth cord having a longitudinal axis extending between first and second ends, said sixth cord first end connected to the third reinforced edge near the third corner, and said sixth cord second end connected to the fourth reinforced edge near the third corner; a seventh cord having a longitudinal axis extending between first and second ends, said seventh cord first end connected to the fourth reinforced edge near the fourth corner, and said seventh cord second end connected to the first reinforced edge near the fourth corner; and an eighth cord adjacent to the seventh cord, said eighth cord having a longitudinal axis extending between first and second ends, said eighth cord first end connected to the fourth reinforced edge near the fourth corner, and said eighth cord second end connected to the first reinforced edge near the fourth corner.

Applicant has still further developed an innovative towel or blanket comprising: a towel base having four reinforced edges meeting at four corners; a first cord having a longitudinal axis extending between first and second ends connected to a first and second of the four reinforced edges near a first of the four corners; and a second cord adjacent to the first cord, said second cord having a longitudinal axis extending between first and second ends connected to the first and second of the four reinforced edges near the first corner, wherein the first and second cords have different stretch characteristics It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only and should not be construed as limiting the invention.

DETAILED DESCRIPTION OF EMBODIMENTS OF THE INVENTION

Figure 1:
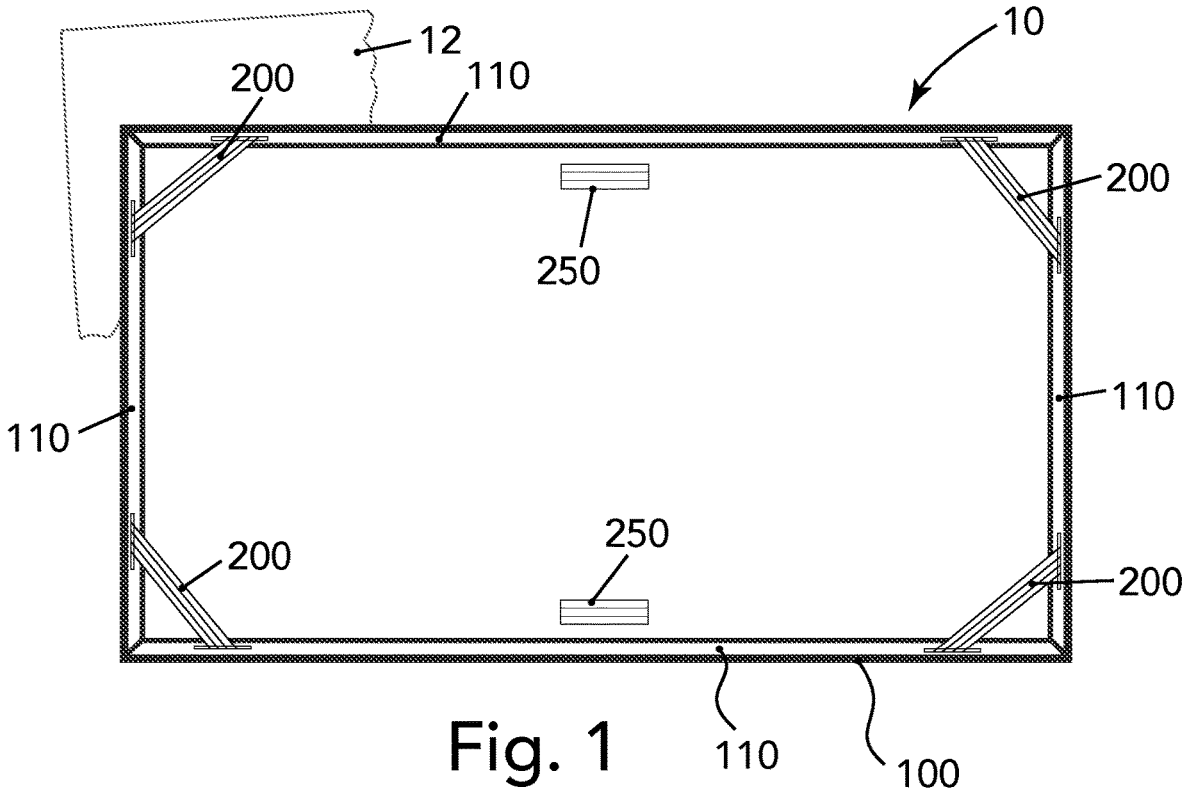
FIG. 1 is a top plan view of a towel having multiple neatly lying flat cords provided at each one of multiple attachment points in accordance with a first embodiment of the invention.
Figure 2:
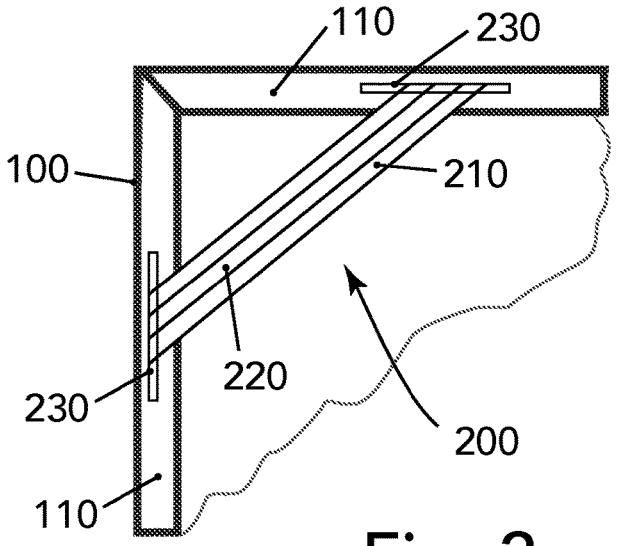
FIG. 2 is an enlarged top plan view of a corner towel attachment point shown in FIG. 1, in accordance with the first embodiment of the invention.

Reference will now be made in detail to embodiments of the present invention, examples of which are illustrated in the accompanying drawings. With reference to FIGS. 1 and 2, embodiments of the towel 10 invention may include a towel base sheet of flexible textile material 100 having a generally linear extending reinforced edge 110 and provided with multiple corner attachment points 200 and side attachment points 250. The towel base 100 is shown fully spread out on a planar surface 12. The generally linear reinforced edge 110 may formed by attaching a folded over portion of the towel base sheet to an adjacent portion of the towel base sheet (i.e., by doubling back over) or by attaching a strip of textile material to the base sheet of flexible textile material. Preferably stitching may be used to hold the components of the reinforced edge together, however the embodiments of the invention are not limited in this regard. The towel base 100 may comprise any suitable towel material, such as, but not limited to, cotton fiber, synthetic fiber, or a natural fiber synthetic fiber blend. Preferably, the towel may include four (4) corner attachment points 200 and at least two (2) side attachment points 250 arranged in an array with one attachment point provided near each corner of the towel, and one attachment point provided near the midpoint between each of the more distal corner attachment points.

Figure 3:
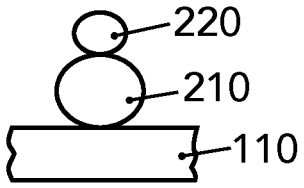
FIG. 3 is a cross-section view of a towel base with first and second neatly lying flat cords attached thereto in accordance with the first embodiment of the invention.

With particular reference to FIG. 2, in a preferred embodiment, each attachment point 200 may include a first cord 210 and a second cord 220 overlaying the first cord. With additional reference to FIG. 3, in the first embodiment, the first and second cords 210 and 220 are connected to the towel reinforced edge 110 and may have a generally circular cross section in the range of approximately ⅛ inch to ¼ inch in diameter layered one on top of the other. The underlying first cord 210 may have a larger diameter or width than the overlying second cord 220. Preferably, the first cord 210 may be paracord having a substantially "non-stretchable" stretch characteristic (i.e., stretches less than five percent (5%) of its overall length when placed under a tensile load of at least 100 pounds). Preferably, the second cord 220 may be shock cord having a substantially "stretchable" stretch characteristic (i.e., capable of stretching fifty to one-hundred percent (50%-100%) of its overall length when placed under a tensile load of at least 100 pounds). When arranged vertically, as shown in FIG. 3, the substantially stretchable second cord 220 is preferably above the substantially non-stretchable first cord 210 relative to the towel reinforced edge 110 so that stretchable cord does not interfere with the non-stretchable cord when stretched.

It is appreciated, however, that in alternative embodiments both of the first and second cords 210 and 220 may be constructed of shocked bungee cord (i.e., shock cord) or paracord and have tensile strengths of at least approximately 100 pounds. The first and second cords 210 and 220 each may be in the range of 1 to 5 inches long, preferably in the range of 1 to 3 inches long, and more preferably in the range of approximately 1.5 to 2 inches long, taken along a longitudinal axis extending between opposite ends of the cords. The length of the first and second cords is selected so that the cords lie neatly flat against the towel base 100 when the cords are in a relaxed state and when or as the towel is fully spread out on the planar surface 12. As a result, when the first and second cords are not in use, the towel 10 may be laid flat without the corners bunching or the first and second cords 210 and 220 extending noticeably away from the surface of the towel base 100 and reinforced edges 110.

Each end of the first and second cords 210 and 220 may be fastened to the towel 100 with shared reinforced stitching 230 preferably using heavy duty thread material at or on the reinforced edge 110. Preferably, each of the first and second cords 210 and 220 are oriented relative to the towel 10 such that their longitudinal axis are set at or approximately at forty-five (45) degree angles relative to the intersecting sides of the towel base 100 at a towel corner. The first and second cords 210 and 220 may be sized and have different widths that permit a standard carabiner (approximately ¼ to ½ inch diameter) to be passed between the cord and the towel base 100. Each of the first and second cords may have a width that is preferably, but not necessarily, in the range of one-eighth (⅛) to one (1) inch across taken perpendicular to the longitudinal axis of the cords.

Figure 4:
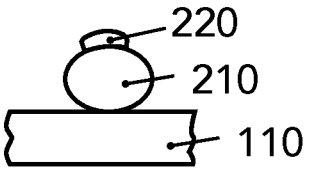
FIG. 4 is a cross-section view of a towel base with first and second neatly lying flat cords attached thereto in accordance with a second embodiment of the invention.
Figure 5:
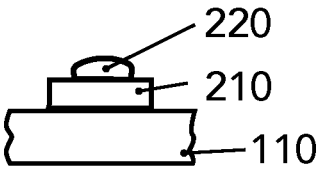
FIG. 5 is a cross-section view of a towel base with first and second neatly lying flat cords attached thereto in accordance with a third embodiment of the invention.
Figure 6:
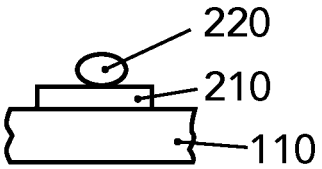
FIG. 6 is a cross-section view of a towel base with first and second neatly lying flat cords attached thereto in accordance with a fourth embodiment of the invention.
Figure 12:
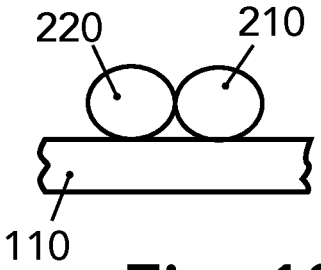
FIG. 12 is a cross-section view of a towel base with first and second neatly lying flat cords attached thereto in accordance with a seventh embodiment of the invention.
Figure 13:
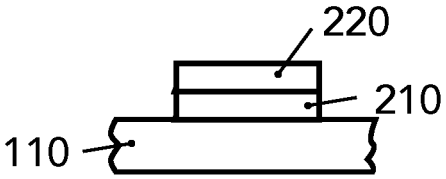
FIG. 13 is a cross-section view of a towel base with first and second neatly lying flat cords attached thereto in accordance with an eighth embodiment of the invention.

With reference to FIG. 4, in an alternative second embodiment of the present invention, the underlying first cord 210 may have a generally circular cross section while the overlying second cord and 220 may be a shock cord bungee strap having a rectangular cross section with a width smaller than the diameter of the first cord. With reference to FIG. 5, in an alternative third embodiment of the present invention, the underlying first cord 210 and the overlying second cord and 220 may both be shock cord bungee straps of different widths having a generally rectangular cross section. With reference to FIG. 6, in an alternative fourth embodiment of the present invention, the underlying first cord 210 may be a shock cord bungee strap having a generally rectangular cross section while the overlying second cord and 220 may have a generally circular cross section with a diameter smaller than the width of the first cord With reference to FIG. 12, in an alternative seventh embodiment of the present invention, the first cord 210 may be constructed of paracord and the second cord and 220 may be constructed of shock cord, and both cords may have substantially the same cross-sectional circular shapes and sizes, and be arranged laterally adjacent to each other relative to the towel reinforced edge 110. With reference to FIG. 13, in an alternative eighth embodiment of the present invention, the first cord 210 may be constructed of paracord and the second cord and 220 may be constructed of shock cord, and both cords may have substantially the same cross-sectional rectangular shapes and sizes, and be arranged vertically adjacent to each other relative to the towel reinforced edge 110.

Figure 7:
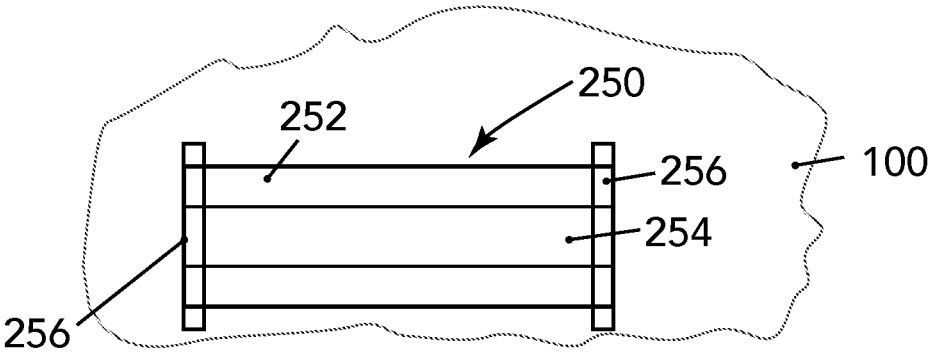
FIG. 7 is an enlarged top plan view of a side mid-point towel attachment point shown in FIG. 1, in accordance with the first embodiment of the invention.

With reference to FIG. 7, a side attachment point 250 is shown in detail to include a first underlying side cord 252 and a second overlying side cord 254 attached to the towel base 100 with shared reinforced stitching 256. The first side cord 252 preferably is wider than the second side cord 254 to allow for easy selection of a cord for receiving a carabiner or other connection structure.

With reference to FIGS. 1-7, in another alternative embodiment of the present invention, one or more of the corner and side attachment points 200 and 250 may have one or both cords constructed of substantially stretchable material (e.g., shock cord) and/or of generally non-stretchable material (e.g., paracord). For example, with reference to FIG. 3, the first and second cords 210 and 220 may both be constructed of substantially stretchable material, both of substantially non-stretchable material, or one of substantially stretchable material and the other of substantially non-stretchable material.

In still a further alternative embodiment of the invention shown in FIGS. 1-7, one or more of the corner attachment points 200 may include first and second cords 210 and 220 having lengths of approximately three (3) inches or more to permit the towel 10 to be rolled and secured by bundling under an attachment point with relatively longer cords (measured along a longitudinal axis).

Figure 8:
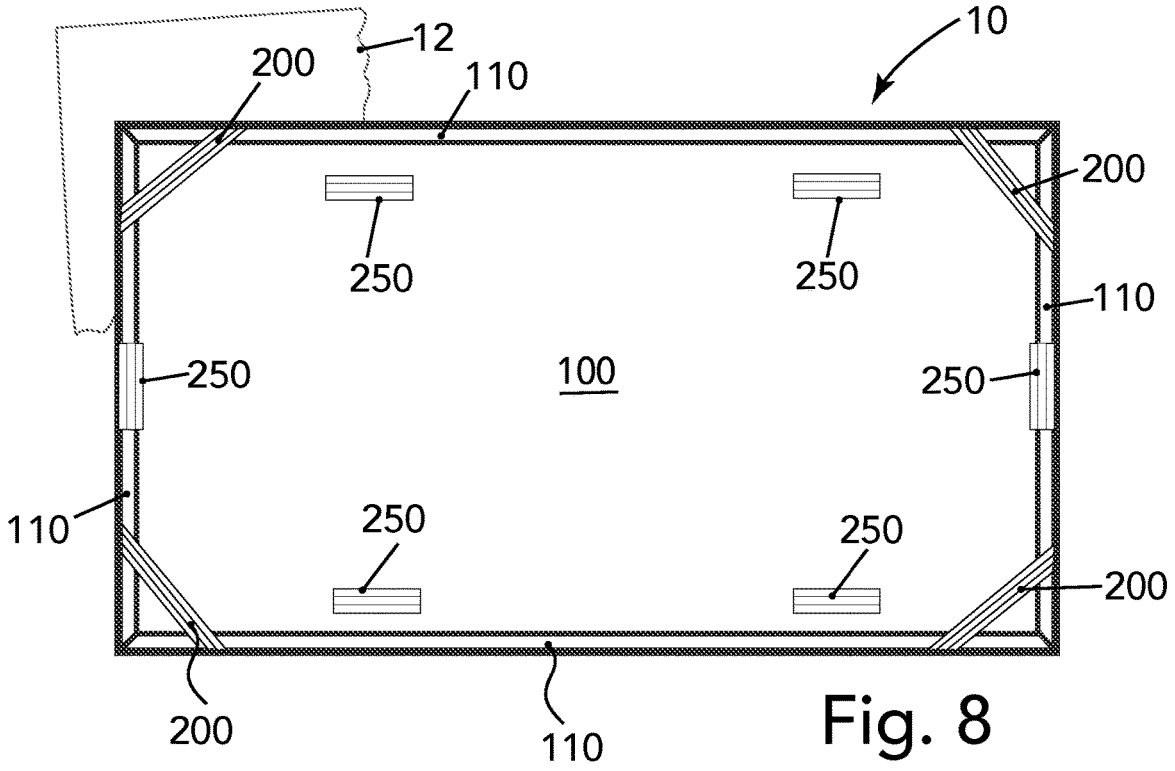
FIG. 8 is a top plan view of a towel having multiple neatly lying flat cords provided at each one of multiple attachment points in accordance with a fifth embodiment of the present invention.

In yet another alternative fifth embodiment illustrated in FIG. 8, in addition to the one or more corner attachment points 200, one or more side attachment points 250 may be provided at or near each of the reinforced elongated edges 110 of the towel base 100.

Figure 9:
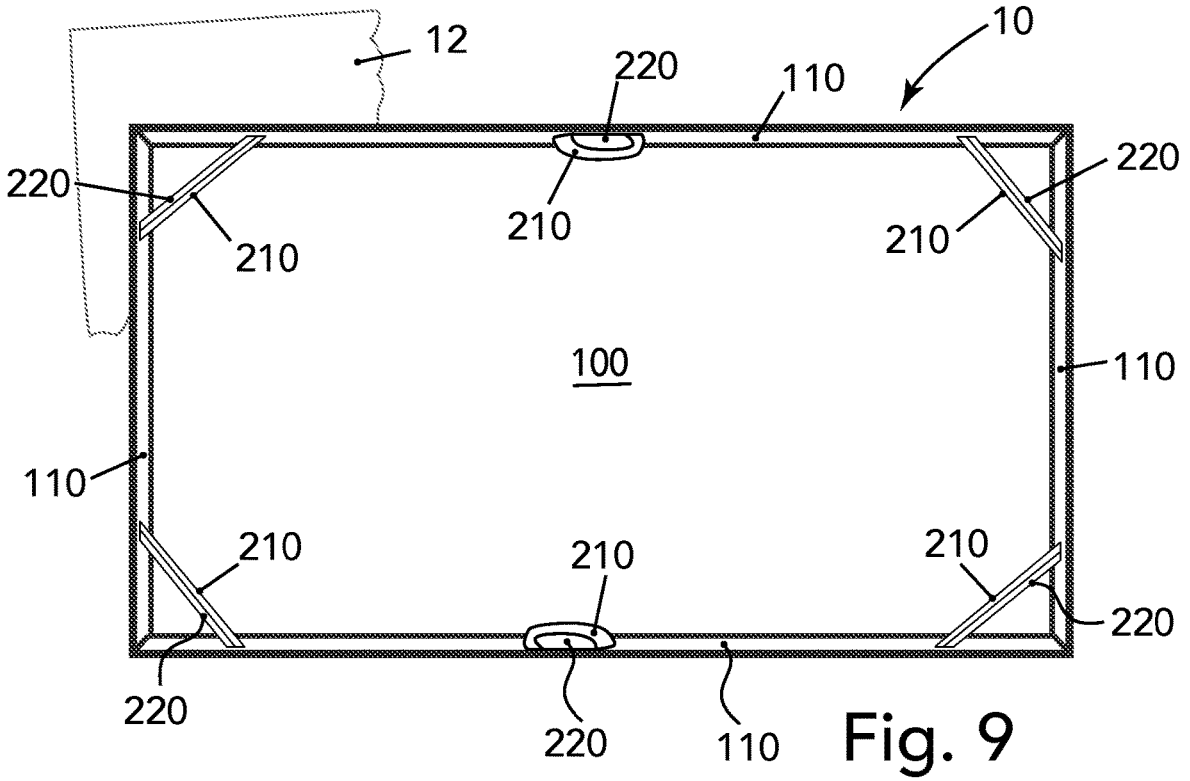
FIG. 9 is a top plan view of a towel having multiple neatly lying flat cords provided at each one of multiple attachment points in accordance with a sixth embodiment of the present invention.
Figure 10:
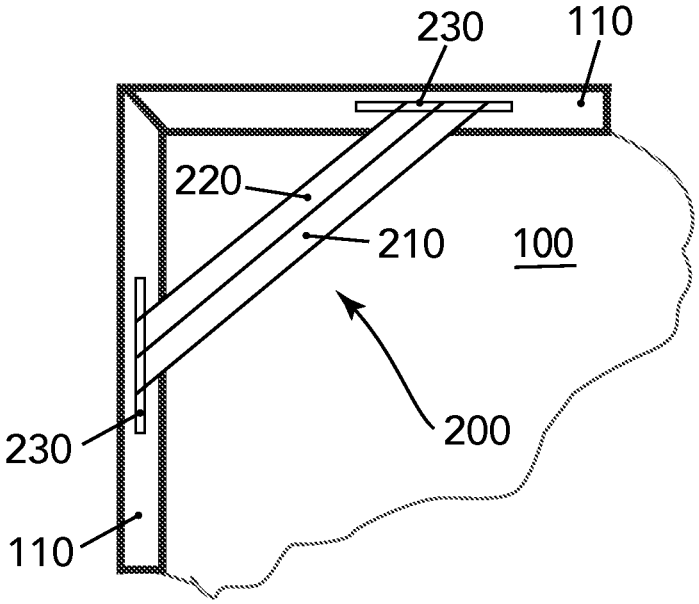
FIG. 10 is an enlarged top plan view of a corner towel attachment point shown in FIG. 9, in accordance with the sixth embodiment of the invention.
Figure 11:
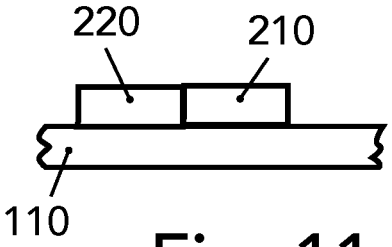
FIG. 11 is a cross-section view of a towel base with first and second neatly lying flat cords attached thereto in accordance with the sixth embodiment of the invention.

With reference to FIGS. 9-11, in an alternative sixth embodiment of the present invention, a towel 10 may include a towel base 100 laid flat on a planar surface 12. The towel base 100 may have four generally linear reinforced edges 110 extending between four corners. Each corner and the two longer reinforced edges may each have an attachment point comprising a first cord 210, which may be constructed of paracord, and a second cord 220, which may be constructed of shock cord. Both the first and second cords 210 and 220 at each attachment point may have substantially the same cross-sectional rectangular shapes and sizes (e.g., webbing cross-sectional shapes), and be arranged laterally adjacent to each other (preferably, but not necessarily touching) relative to the towel reinforced edge 110. The ends of the first and second cords 210 and 220 may be connected to the towel reinforced edges 110 using heavy-duty stitching 230 or other fasteners such as staples, rivets, pins, snaps, adhesive or the like.

As will be understood by those skilled in the art, the invention may be embodied in other specific forms without departing from the spirit or essential characteristics thereof. The elements described above are provided as illustrative examples for implementing the invention. One skilled in the art will recognize that many other implementations are possible without departing from the present invention as recited in the claims. For example, the shapes, sizes and selected materials of various elements of the embodiments of the invention may be changed without departing from the intended scope of the invention. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. A towel or blanket comprising:

a base sheet of flexible textile material having a first, a second, a third and a fourth generally linear reinforced outermost edge each formed by attaching a folded over portion of the base sheet of flexible textile material to an adjacent portion of the base sheet of flexible textile material or by attaching a strip of textile material to the base sheet of flexible textile material, wherein the first and second reinforced outermost edges meet at a first corner, the second and third reinforced outermost edges meet at a second corner, the third and fourth reinforced outermost edges meet at a third corner, and the first and fourth reinforced outermost edges meet at a fourth corner;

a first cord having a longitudinal axis extending between first and second ends, said first cord first end connected to the first reinforced outermost edge near the first corner, and said first cord second end connected to the second reinforced outermost edge near the first corner;

a second cord adjacent to the first cord, said second cord having a longitudinal axis extending between first and second ends, said second cord first end connected to the first reinforced outermost edge near the first corner, and said second cord second end connected to the second reinforced outermost edge near the first corner;

a third cord having a longitudinal axis extending between first and second ends, said third cord first end connected to the second reinforced outermost edge near the second corner, and said third cord second end connected to the third reinforced outermost edge near the second corner;

a fourth cord adjacent to the third cord, said fourth cord having a longitudinal axis extending between first and second ends, said fourth cord first end connected to the second reinforced outermost edge near the second corner, and said fourth cord second end connected to the third reinforced outermost edge near the second corner;

a fifth cord having a longitudinal axis extending between first and second ends, said fifth cord first end connected to the third reinforced outermost edge near the third corner, and said fifth cord second end connected to the fourth reinforced outermost edge near the third corner;

a sixth cord adjacent to the fifth cord, said sixth cord having a longitudinal axis extending between first and second ends, said sixth cord first end connected to the third reinforced outermost edge near the third corner, and said sixth cord second end connected to the fourth reinforced outermost edge near the third corner;

a seventh cord having a longitudinal axis extending between first and second ends, said seventh cord first end connected to the fourth reinforced outermost edge near the fourth corner, and said seventh cord second end connected to the first reinforced outermost edge near the fourth corner; and an eighth cord adjacent to the seventh cord, said eighth cord having a longitudinal axis extending between first and second ends, said eighth cord first end connected to the fourth reinforced outermost edge near the fourth corner, and said eighth cord second end connected to the first reinforced outermost edge near the fourth corner, wherein the reinforced outermost edge of textile material at the first corner is a most distal portion of the base sheet spaced away from the reinforced outermost edge of textile material at the third corner when the base sheet of flexible textile material is fully spread out on a planar surface.

2. The towel or blanket of claim 1 wherein the first and second cords have different stretch characteristics.

3. The towel or blanket of claim 1 wherein the first, third, fifth and seventh cords are paracord, and the second, fourth, sixth and eighth cords are shock cord.

4. The towel or blanket of claim 3 wherein the first, third, fifth and seventh cords are flat paracord webbing.

5. The towel or blanket of claim 4 wherein the second, fourth, sixth and eighth cords are flat shock cord.

6. The towel or blanket of claim 1 wherein the first, third, fifth and seventh cords are configured to stretch less than five percent along the longitudinal axis, and the second, fourth, sixth and eighth cords are configured to stretch in the range of fifty to one hundred percent along the longitudinal axis.

7. The towel or blanket of claim 1 wherein the first and second cord longitudinal axis are oriented at approximately a forty-five degree angle relative to the first and second linear reinforced outermost edges.

8. The towel or blanket of claim 1 wherein the first and second ends of the first cord are approximately equidistant from the first corner, and the first and second ends of the second cord are approximately equidistant from the first corner.

9. The towel or blanket of claim 1 wherein the first and second cords are laterally adjacent to each other relative to the base sheet of flexible textile material as fully spread out on a planar surface.

10. The towel or blanket of claim 9 wherein the first, third, fifth and seventh cords are paracord, and the second, fourth, sixth and eighth cords are shock cord.

11. The towel or blanket of claim 1 wherein the second cord overlies the first cord relative to the base sheet of flexible textile material as fully spread out on a planar surface.

12. The towel or blanket of claim 11 wherein the first, third, fifth and seventh cords are paracord, and the second, fourth, sixth and eighth cords are shock cord.

13. The towel or blanket of claim 1 wherein the first and second cords are configured to lie generally flat against the base sheet of flexible textile material as fully spread out on a planar surface.

14. The towel or blanket of claim 1 wherein the first, second, third, fourth, fifth, sixth, seventh and eighth cords are in the range of 1 to 5 inches in length taken along the longitudinal axis.

15. The towel or blanket of claim 1 wherein the first, second, third, fourth, fifth, sixth, seventh and eighth cords are in the range of 1.5 to 3 inches in length taken along the longitudinal axis.

16. The towel or blanket of claim 1 further comprising:

a ninth cord having a longitudinal axis extending between first and second ends, said ninth cord first and second ends connected to the second reinforced outermost edge or the base sheet of flexible textile material near a midpoint of the second reinforced outermost edge, wherein the ninth cord is configured to lie generally flat against the base sheet of flexible textile material as fully spread out on a planar surface; and a tenth cord adjacent to the ninth cord, said tenth cord having a longitudinal axis extending between first and second ends, said tenth cord first and second ends connected to the second reinforced outermost edge or the base sheet of flexible textile material near a midpoint of the second reinforced outermost edge, wherein the tenth cord is configured to lie generally flat against the base sheet of flexible textile material as fully spread out on a planar surface;

wherein the ninth and tenth cords have different stretch characteristics.

17. The towel or blanket of claim 16 wherein the ninth and tenth cords are in the range of 1 to 3 inches in length taken along the longitudinal axis.

18. The towel or blanket of claim 16 wherein the ninth cord is paracord, and the tenth cord is shock cord.

19. The towel or blanket of claim 1 wherein said first cord first end is connected to the first reinforced outermost edge using stitching, said first cord second end is connected to the second reinforced outermost edge using stitching, said second cord first end is connected to the first reinforced outermost edge using stitching, and said second cord second end is connected to the second reinforced outermost edge using stitching.

20. A towel or blanket comprising:

a towel or blanket base having four outermost reinforced edges meeting at four corners;

a first cord having a longitudinal axis extending between first and second ends connected to a first and second of the four reinforced edges near a first of the four corners;

a second cord adjacent to the first cord, said second cord having a longitudinal axis extending between first and second ends connected to the first and second of the four reinforced edges near the first corner;

a third cord having a longitudinal axis extending between first and second ends, said third cord first and second ends connected to one of the four reinforced outermost edges near a midpoint between two of the four corners taken along the one of the four outermost edges, wherein the third cord is configured to lie generally flat against the towel or blanket base as fully spread out on a planar surface; and a fourth cord having a longitudinal axis extending between first and second ends, said fourth cord first and second ends connected to the one of the four reinforced outermost edges near the midpoint between the two of the four corners taken along the one of the four outermost edges, wherein the fourth cord is adjacent to the third cord and is configured to lie generally flat against the towel or blanket base as fully spread out on a planar surface, wherein the first and second cords have different stretch characteristics and the third and fourth cords have different stretch characteristics.

* * * * *